United States Patent [19]

Taguchi

[11] Patent Number: 4,604,069

[45] Date of Patent: Aug. 5, 1986

[54] EXHAUST SILENCER STRUCTURE FOR OUTBOARD ENGINES

[75] Inventor: Michihiro Taguchi, Hamamatsu, Japan

[73] Assignee: Sanshin Kogyo Kabushiki Kaisha, Japan

[21] Appl. No.: 633,792

[22] Filed: Jul. 24, 1984

[30] Foreign Application Priority Data

Jul. 28, 1983 [JP] Japan ..... 58-136829

[51] Int. Cl.[4] ..... B63H 21/38

[52] U.S. Cl. ..... 440/88; 440/89

[58] Field of Search ..... 440/76, 88, 89; 60/310; 123/41.31; 181/251, 260

[56] References Cited

U.S. PATENT DOCUMENTS

| | | | |
|---|---|---|---|
| 3,198,162 | 8/1965 | Larsen | 440/89 |
| 3,310,022 | 3/1967 | Kollman . | |
| 3,350,879 | 11/1967 | Boda et al. . | |
| 3,520,270 | 7/1970 | Miller . | |
| 3,750,614 | 8/1973 | Giacosa | 440/89 |
| 4,303,401 | 12/1981 | Sanmi et al. | 440/89 |
| 4,354,849 | 10/1982 | Sanmi et al. . | |
| 4,421,490 | 12/1983 | Nakahama . | |

FOREIGN PATENT DOCUMENTS

| | | | |
|---|---|---|---|
| 80995 | 5/1982 | Japan | 440/89 |
| 57-140293 | 8/1982 | Japan . | |

*Primary Examiner*—Trygve M. Blix
*Assistant Examiner*—Stephen P. Avila
*Attorney, Agent, or Firm*—Ernest A. Beutler

[57] ABSTRACT

An exhaust and exhaust cooling system for an outboard motor including an improved slow speed exhaust gas discharge including a plurality of expansion chambers and a water chamber through which exhaust gases must pass before discharge to an above the water slow speed exhaust gas discharge opening. A number of cooling jackets encircle portions of the exhaust system and coolant from the engine is delivered from these jackets both into the high speed and slow speed exhaust gas discharges.

15 Claims, 5 Drawing Figures

EXHAUST SILENCER STRUCTURE FOR OUTBOARD ENGINES

BACKGROUND OF THE INVENTION

This invention relates to an exhaust silencer structure for outboard motors and more particularly to an improved system for silencing the low speed exhaust gas discharge of such an engine.

As is well known, it is the practice with outboard motors to silence the exhaust gases of the powering engine by discharging them through an underwater exhaust gas outlet and by employing silencing devices within the outboard motor itself for silencing the gases before their discharge through this underwater outlet. However, it is also the practice to discharge the exhaust gases at idle and low speeds through an above the water exhaust gas outlet since the underwater outlet would offer too great a flow resistance under these running conditions. Thus, the discharge of the exhaust gases directly to the atmosphere presents particularly problems in connection with silencing. In U.S. Pat. No. 4,421,490, issued Dec. 20, 1983, and entitled "Exhaust Silencer Structure For Outboard Engines" and assigned to the assignee of this application, there is disclosed an exhaust gas system wherein exhaust gases for low speed are discharged to the atmosphere through a water bath contained within the confines of the motor. Although such devices can offer good silencing, the water bath itself may, if it is the only form of silencing employed, give too high a back pressure.

It is, therefore, a principal object of this invention to provide an improved, effective low speed exhaust gas silencing system for an outboard motor.

It is another object of this invetion to provide a low speed exhaust gas silencing system for an outboard motor that is effective and yet which generates low back pressure.

In connection with the exhaust systems for outboard motors, it has been proposed to use the discharge cooling water of the engine as a means for further improving exhaust silencing and exhaust gas treatment. For example, it has been proposed to add a portion of the discharge coolant water to the exhaust gases to cool them and improve silencing.

It is, therefore, a still further object of this invention to provide an improved cooling system for an outboard motor.

It is a yet further object of this invention to provide an outboard motor cooling system wherein the coolant assists in the exhaust gas treatment.

SUMMARY OF THE INVENTION

A first feature of this invention is adapted to be embodied in an exhaust system for an outboard motor or the like having a drive shaft housing and a lower unit that is adapted to be at least partially submerged in the water. An internal combustion engine that has an exhaust gas outlet is incorporated and the motor has a high speed exhaust gas discharge normally positioned below the water level. In addition, a slow speed exhaust gas discharge is incorporated that is adapted to be normally positioned above the water level. A high speed exhaust gas system delivers exhaust gases from the engine exhaust gas outlet to the high speed exhaust gas discharge. In addition, there is employed a slow speed exhaust system for delivering exhaust gases from the engine exhaust gas outlet to the slow speed exhaust gas discharge. The slow speed exhaust gas system includes a water chamber formed in the drive shaft housing and through which exhaust gases must pass from the exhaust gas outlet to the slow speed exhaust gas discharge. In accordance with this feature of the invention, the slow speed exhaust system includes a plurality of expansion chambers through which the exhaust gases pass from the exhaust gas outlet to the slow speed exhaust discharge.

Another feature of the invention is adapted to be embodied in an outboard motor having a power head containing a water cooled internal combustion engine having an exhaust gas outlet and a drive shaft housing depending from the power head and having an exhaust pipe in communication with the exhaust gas outlet of the engine. A first coolant jacket surrounds the exhaust gas outlet of the engine and is adapted to receive coolant from the engine coolant jacket. A second coolant jacket surrounds the exhaust pipe and is adapted to receive coolant from the first coolant jacket. First discharge means discharge coolant from the second coolant jacket into proximity with the outer periphery of the exhaust pipe. Second discharge means also extend from the second coolant jacket for delivering coolant from the second coolant jacket back to the body of water in which the motor operates.

DETAILED DESCRIPTION OF THE PREFERRED EMBODIMENT

Figure 1:
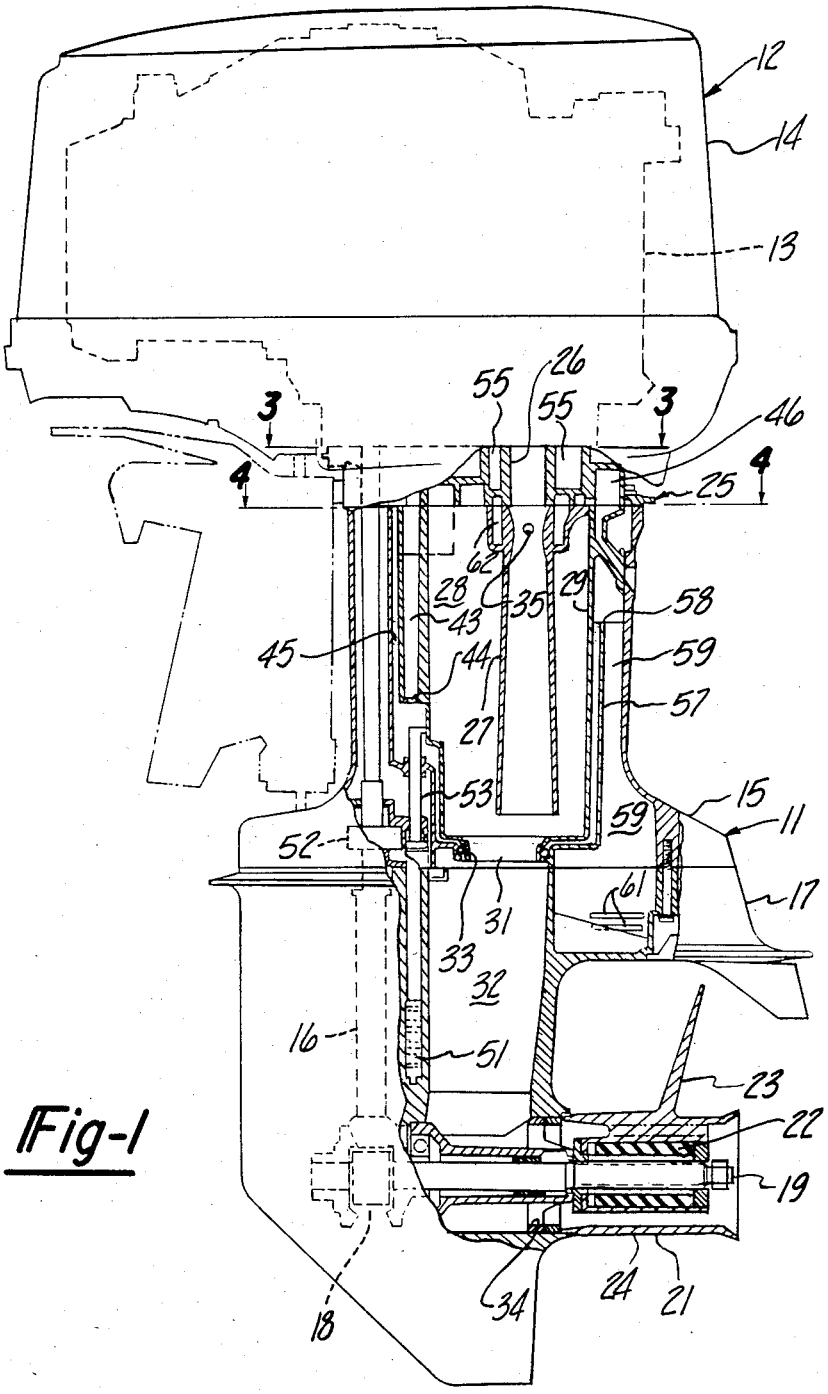
FIG. 1 is a side elevational view, with portions broken away, of an outboard motor constructed in accordance with an embodiment of the invention.

Referring first to FIG. 1, an outboard motor constructed in accordance with an embodiment of the invention is identified generally by the reference numeral 11. The outboard motor 11 includes a power head, indicated generally by the reference numeral 12 and containing an internal combustion engine 13 that is surrounded by a protective cowling 14. The engine 13 is of any known type, for example, a multi-cylinder reciprocating engine operating on the two-cycle principle. In accordance with conventional outboard motor practice, the engine 13 is disposed so that its output or crankshaft rotates about a generally vertically extending axis.

Depending from the power head 12 and affixed to it in a known manner is a drive shaft housing, indicated generally by the reference numeral 15 and which includes an outer housing in which a drive shaft, indicated by the reference numeral 16 and which is driven by the engine output shaft 13, is rotatably supported in a suitable manner. The drive shaft 16 extends through the drive shaft housing 15 into a lower unit 17 that is affixed to the drive shaft housing 15 and in which a suitable forward, neutral, reverse transmission, indicated by the reference numeral 18 is positioned for driving a propeller shaft 19. A propeller, indicated by the reference numeral 21, is affixed to the propeller shaft 19 by means of an elastomeric coupling 22 and which has a plurality of blades 23 extending from its outer surface. The propeller 21 has a plurality of axially extending exhaust gas discharges 24 extending through it, for a reason to be described.

The construction of the engine 11 as thus far described is conventional and, for that reason, details of the various conventional components have not been illustrated nor will they be described. The subject matter of the invention has to do with the exhaust system for the engine 13 and the cooperation of the cooling system with this exhaust system to provide an efficient exhaust. This exhaust system includes a guide plate, indicated generally by the reference numeral 25, which is interposed between the power head 12 and the drive shaft housing 15. The guide plate 25 has an exhaust port 26 that is aligned with the exhaust gas outlet of the engine 13 which is not shown but which may be considered to be conventional in construction and orientation.

The lower end of the exhaust passage 26 communicates with the upper end of an exhaust pipe 27 that is supported within the drive shaft housing 15 and which extends into an expansion chamber, indicated generaly by the reference numeral 28, which is formed by a partition member 29 that is supported within the drive shaft housng 15. The lower end of the partition member 29 is formed with a flanged outlet 31 of restricted cross-sectional area that opens into an expansion chamber 32 formed in the lower unit 17. An annular seal 33 surrounds the flanged portion 31 and forms a seal between the member 29 and the wall of the lower unit 17 which defines the expansion chamber 32.

The lower end of the expansion chamber 32 of the lower unit 17 terminates in a rearwardly directed high speed exhaust gas outlet discharge 34. The discharge 34 communicates with the propeller axially extending exhaust discharge 24 so as to discharge the exhaust gases through the propeller 21 into the body of water in which the motor 11 is operating at high speeds. High speed exhaust gas silencing is provided by tuning the size and length of the exhaust pipe 27, the volume of the expansion chambers 28 and 32 and the relationship between the expansion chambers 28 and 32 and the comunicating narrow passageway 31. In addition, the underwater exhaust of the exhaust gases at high speeds will provide an effective high speed exhaust gas silencing.

When the outboard motor 11 is driving the associated watercraft at a low speed or when it is idling, the motor 11 and specifically its lower unit 17 will be submerged to a greater extent in the body of water than when travelling at high speeds. This greater degree of submersion of the propeller 21 and specifically its exhaust discharges 24 will increase the back pressure of the exhaust gases tending to leave the high speed exhaust gas outlet sufficiently so as to be excessive at these running speeds. In order to achieve exhaust gas emission at these low engine speeds while at the same time providing effective silencing, an above the water low speed exhaust gas system is provided. This system includes a series of expansion chambers and a water bath through which the exhaust gases must pass before they are discharged to the atmosphere. Thus, a very effective exhaust silencing system is provided for low speeds which, at the same time, does not unduly increase exhaust gas back pressure.

Figure 4:
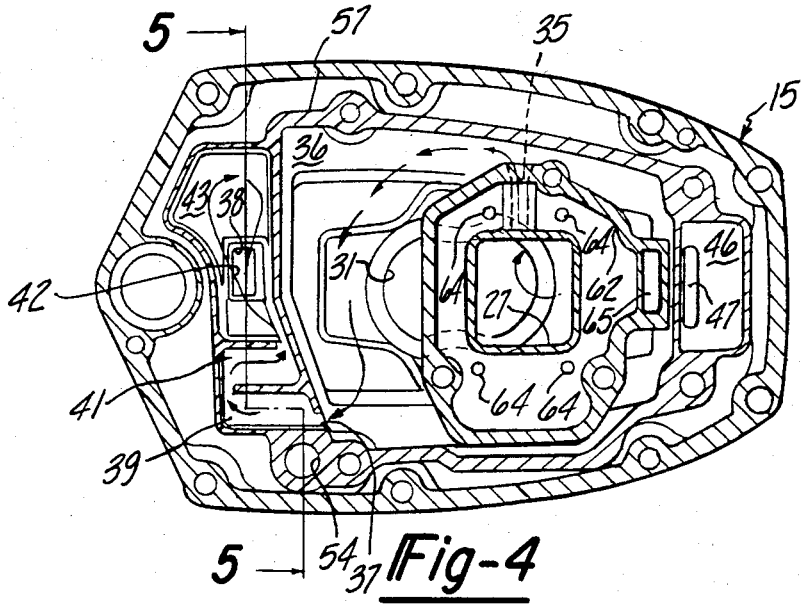
FIG. 4 is a cross-sectional view taken along the line 4—4 of FIG. 1.
Figure 5:
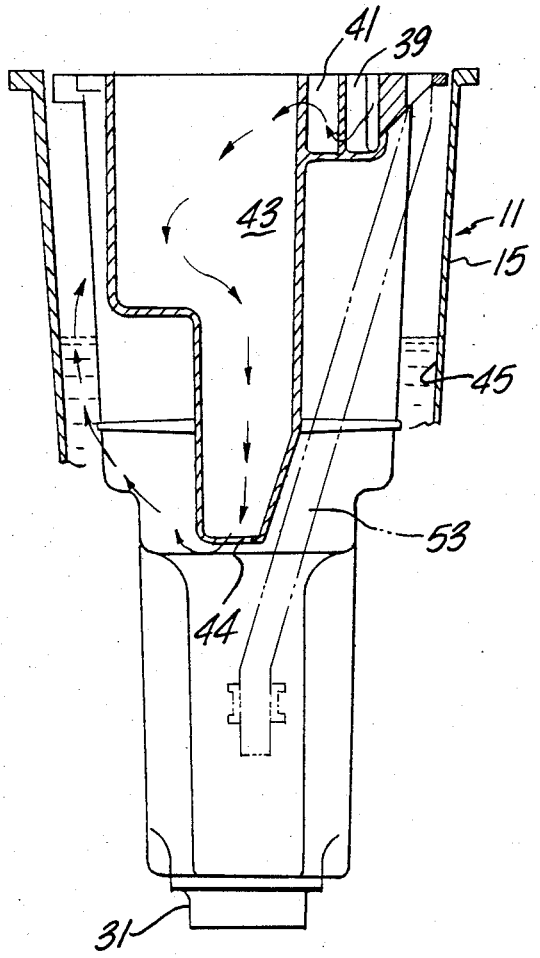
FIG. 5 is a cross-sectional view taken along the line 5—5 of FIG. 4.

A low speed exhaust gas passage 35 extends through the exhaust pipe 27 adjacent its inlet end where it registers with the exhaust passage 26 of the guide plate 25. The passage 35 extends generally from a throat of the exhaust pipe 27 and terminates in an expansion chamber 36 that is formed in the upper portion of the drive shaft housing 15. From the expansion chamber 36, the exhaust gases flow through a small restricted passage 37 into an expansion chamber 38 that is made up of a number of sections 39, 41 and 42 through a tortuous path as may be readily seen from FIG. 4. The successive contractions and expansions while the exhaust gases flow through this tortuous path give rise to a good silencing effect without increasing substantially the back pressure on the exhaust gases.

From the expansion chamber section 42, the exhaust gases flow through an idle exhaust gas passage 43 that extends in a generally vertical direction and which has an restricted opening 44 formed at its lower end. The opening 44 discharges into a water reservoir 45, in which a uniform head of water is maintained in a manner to be described, at a predetermined distance below its upper level. Hence, exhaust gases must flow from the passage 44 vertically upwardly through the water bath contained in the reservoir 45.

Figure 2:
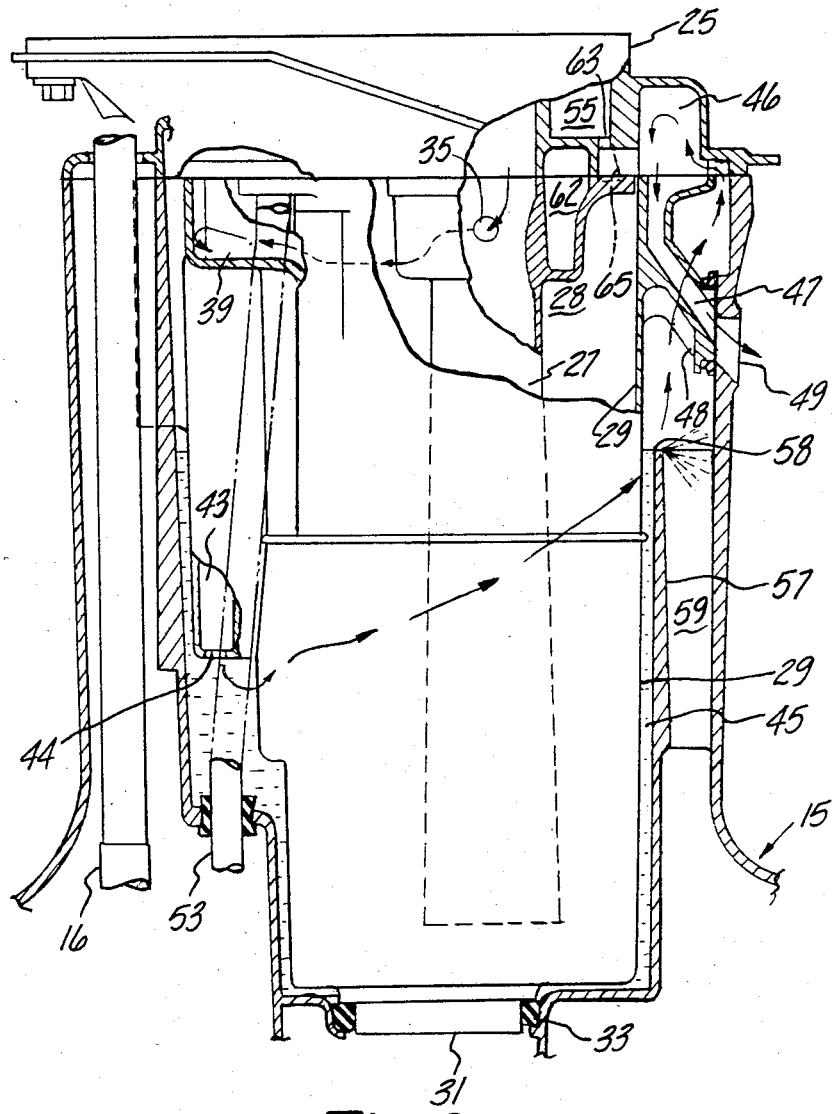
FIG. 2 is an enlarged side elevational view, with other portions broken away, showing the slow speed exhaust gas discharge.
Figure 3:
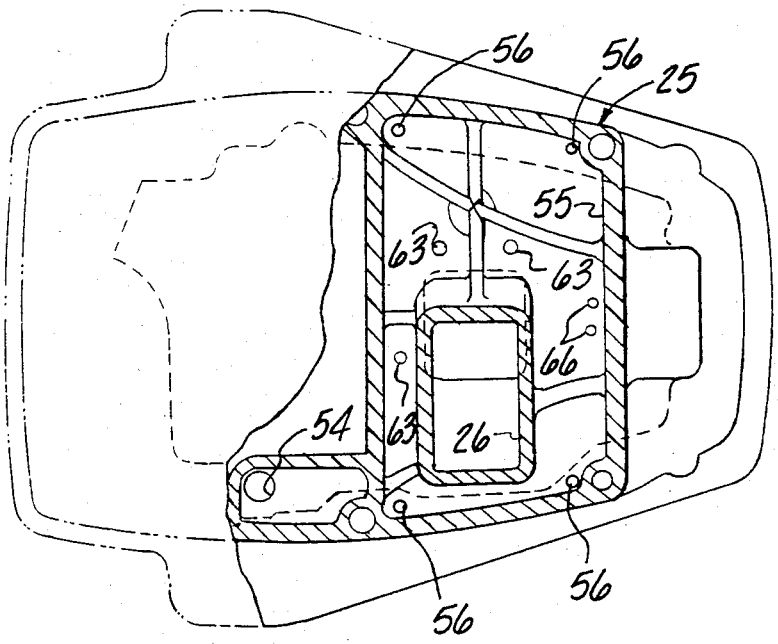
FIG. 3 is a cross-sectional view taken generally along the line 3—3 of FIG. 1.

From the water reservoir 45, the idle exhaust gases pass upwardly (FIG. 2) through a further expansion chamber 46 that is formed in the guide plate 25. From the expansion chamber 46, the idle exhaust gases flow through an outlet passage 47 formed in an extension 48 of the member 29. This extension meets with an idle discharge opening 49 that is formed in the drive shaft housing 15 at a point above the water level. Hence, idle exhaust gases will flow through a series of successive expansion and contractions provided by the expansion chambers and the water bath provided in the reservoir 45 before discharge to the atmosphere. In addition, the path is a tortuous one and this will effectively silence the exhaust gases before they are discharged to the atmosphere. In addition, the use of the several expansion chambers permits the utilization of a water bath having a relatively shallow head and hence there need not be any great pressure introduced into the exhaust system.

The cooling system for the engine 13 and specifically its interrelationship with the exhaust system will now be described. The lower unit 17 is provided with a suitable inlet opening for admitting water from the body in which the motor 11 is operating into an inlet cavity 51. A coolant pump 52 is driven by the drive shaft 16 and is contained at the lower portion of the drive shaft housing 15. The coolant pump draws water from the inlet cavity 51 for discharge through a coolant pipe 53 that extends vertically through the drive shaft housing 15. The delivery pipe 53 passes through the reservoir 45 as clearly shown in FIG. 2. The upper end of the delivery pipe 53 registers with a coolant inlet of the engine 13 which includes a passage 54 formed in the guide plate 25. From the passage 54, the coolant is delivered to the coolant jacket of the engine 13 for circulation by the pump 52 in any suitable manner.

The coolant from the engine 13 is discharged into a first water jacket 55 that is formed by the exhaust guide plate 26 around its exhaust gas passage 26. Hence, the coolant from the engine will surround this passage 26 and provide an initial cooling of the exhaust gases before they are discharged into the drive shaft housing 15. This cooling in addition to lowering the thermal loading on the drive shaft housing 15 will provide an initial silencing effect.

From the coolant jacket 55, the coolant may follow a first path through a series of peripherally spaced discharge openings 56 formed at the four corners of the lower end of the coolant jacket 55. The openings 56 are vertically aligned with the water reservoir 45 so that coolant from the jacket 55 may flow into the reservoir 45. The reservoir 45 is comprised of the member 29 and a peripheral cup shaped member 57 that extends around the member 29 and which forms the water reservoir 45. The member 57 terminates, however, at a wall 58 so that any coolant discharged into the reservoir 45 will fill the reservoir 45 and then flow over the wall 58 into a water discharge opening 59 formed in the drive shaft housing 15. This coolant can them flow into the lower unit 17 for discharge back into the body of water through discharge outlets 61.

Coolant also may flow from the first cooling jacket 55 into a second cooling jacket 62 which is formed in both the guide plate 25 and exhaust pipe 27 so as to provide a cooling jacket around the inlet end of the exhaust pipe 27. This provides additional cooling of the exhaust pipe 27 and the exhaust gases which flow through it so as to further improve silencing. The coolant is delivered from the jacket 55 to the jacket 62 by means of a plurality of vertically extending openings 63 that are formed in the lower wall of the jacket 55 and in proximity to the jacket 62 for gravity flow of coolant between these two jackets.

From the coolant jacket 62, water is discharged vertically downwardly through four spaced openings 64 formed in the lower wall of the jacket 62 and in proximity to the exhaust pipe 27. This coolant comes into contact with the exhaust pipe 27 and will serve to additionally cool it. In addition, the coolant that contacts the exhaust pipe 27 will mix with the high speed exhaust gases for discharge through the exhaust outlet consisting of the expansion chamber 32, discharge 34 and propeller discharges 24.

Coolant is further delivered from the coolant jacket 55 to a coolant discharge chamber 65 formed in proximity to the jacket 62. This coolant is delivered by means of a pair of rearwardly spaced openings 66 in the lower wall of the jacket 55 and vertically above the water coolant discharge chamber 65. Coolant from the chamber 65 may flow over a weir type discharge into the idle expansion chamber 46 for cooling the idle exhaust gases and mixing with them for discharge through the idle discharge opening 49.

It should be readily apparent from the foregoing description that a highly effective system is provided for silencing the exhaust gases for idle and low speed discharge without substantially increasing the back pressure to the discharge of these gases. In addition, the cooling system of the engine and specifically its manner of discharge is constructed in such a way so that the exhaust gases will not heat the drive shaft housing significantly and further the coolant is employed as a device for assisting in the silencing.

Although an embodiment of the invention has been illustrated and described, various changes and modifications may be made without departing from the spirit and scope of the invention, as defined by the appended claims.

I claim:

1. In an exhaust system for an outboard motor or the like having a drive shaft housing and a lower unit adapted to be at least partially submerged in the water, an internal combustion engine having a coolant jacket and an exhaust gas outlet, a high speed exhaust gas discharge normally positioned below the water level, a slow speed exhaust gas discharge normally positioned above the water level, a high speed exhaust system for delivering exhaust gases from said engine exhaust gas outlet to said high speed exhaust gas discharge, including a main expansion chamber formed at least in part in said drive shaft housing and an exhaust pipe extending from said exhaust gas outlet and opening into said main expansion chamber, and a slow speed exhaust system for delivering exhaust gases from said engine exhaust gas outlet to said slow speed exhaust gas discharge and including a water chamber formed in said drive shaft housing through which exhaust gases must pass from said exhaust gas outlet to said slow speed exhaust gas discharge, means for supplying coolant from said engine coolant jacket to said water chamber, the improvement comprising said slow speed exhaust system including a plurality of expansion chambers separate from said main expansion chamber and through which exhaust gases pass from said engine exhaust gas outlet to said slow speed gas discharge and means for delivering coolant from said engine coolant jacket to said slow speed exhaust gas discharge for cooling the exhaust gases delivered to the atmosphere from said slow speed exhaust gas discharge.

2. In an exhaust system as set forth in claim 1 wherein the exhaust gases are delivered to the water chamber at a predetermined distance between the level of water therein for discharge upwardly through the water chamber.

3. In an exhaust system as set forth in claim 1 wherein the coolant is added to the exhaust gases in one of the slow speed exhaust system expansion chambers.

4. In an exhaust system as set forth in claim 1 further including an exhaust cooling jacket surrounding at least a portion of the path of exhaust gas flow and receiving coolant from the engine cooling system.

5. In an exhaust system as set forth in claim 4 wherein the exhaust cooling jacket surrounds the exhaust pipe.

6. In an exhaust system for an outboard motor or the like having a drive shaft housing a lower unit adapted to be at least partially submerged in the water, an internal combustion engine having an exhaust gas outlet, a high speed exhaust gas discharge normally positioned below the water level, a slow speed exhaust gas discharge normally positioned above the water level, a high speed exhaust system for delivering exhaust gases from said engine exhaust gas outlet to said high speed exhaust gas discharge, including a main expansion chamber formed at least in part in said drive shaft housing and an exhaust pipe extending from said exhaust gas outlet and opening into said main expansion chamber, and a slow speed exhaust system for delivering exhaust gases from said engine exhaust gas outlet to said slow speed exhaust gas discharge and including a water chamber formed in said drive shaft housing through which exhaust gases must pass from said exhaust gas outlet to said slow speed gas discharge, the improvement comprising said slow speed exhaust gas system including a plurality of expansion chambers separate from said main expansion chamber and through which exhaust gases pass from said engine exhaust gas oulet to said slow speed exhaust gas discharge, said expansion chambers of the slow speed exhaust gas system including at least one expansion chamber upstream of the water chamber and at least one expansion chamber downstream of the water chamber.

7. In an exhaust system as set forth in claim 6 wherein there are a plurality of expansion chambers upstream of the water chamber.

8. An outboard motor having a power head containing a water cooled internal combustion engine having an exhaust gas outlet, a drive shaft housing depending from said power head and having an exhaust pipe in communication with said exhaust gas outlet of said engine, a first coolant jacket surrounding said engine exhaust gas outlet and adapted to receive coolant from the engine coolant jacket, a second coolant jacket surrounding said exhaust pipe and adapted to receive coolant from said first coolant jacket, said exhaust pipe having an exterior portion spaced from said second coolant jacket and having an air gap surrounding said exterior portion, first discharge means from said second coolant jacket for discharging coolant to impinge on said exterior portion of said exhaust pipe within said air gap for cooling said exhaust pipe, and second discharge means from said second coolant jacket for delivering coolant from said second coolant jacket back to the body of water in which said motor operates.

9. An outboard motor as set forth in claim 8 further including a slow speed exhaust gas discharge for delivering exhaust gases from the exhaust gas outlet of the engine to an above the water exhaust gas discharge opening formed in the drive shaft housing and including a water chamber through which exhaust gases must pass before discharge through said slow speed exhaust gas discharge opening and filled with coolant from the first coolant jacket.

10. An outboard motor as set forth in claim 9 further including a plurality of expansion chambers interposed in the flow of exhaust gases to the slow speed exhaust gas discharge opening.

11. In an exhaust system as set forth in claim 9 wherein the exhaust gases are delivered to the water chamber through a restricted opening.

12. In an exhaust system as set forth in claim 10 wherein the exhaust gases are delivered to the water chamber through a restricted opening.

13. In an exhaust system for an outboard motor or the like having a drive shaft housing and a lower unit adapted to be at least partially submerged in the water, an internal combustion engine having a cooling jacket and an exhaust gas outlet, a high speed exhaust gas discharge normally positioned below the water level, a slow speed exhaust gas discharge normally positioned above the water level, a high speed exhaust system for delivering exhaust gases from said engine exhaust gas outlet to said high speed exhaust gas discharge including a main expansion chamber formed at least in part in said drive shaft housing and an exhaust pipe extending from said exhaust gas outlet and opening into said main expansion chamber, and a slow speed exhaust gas system for delivering exhaust gases from said engine exhaust gas outlet to said slow speed exhaust gas discharge and including a water chamber formed in said drive shaft housing through which exhaust gases must pass from said exhaust gas outlet to said slow speed exhaust gas discharge, means for supplying coolant from said engine coolant jacket to said water chamber and maintaining a constant head during running of said engine, said exhaust gases being delivered to said water chamber at a predetermined distance between the level of water therein for discharge upwardly through said water chamber, the improvement comprising said slow speed exhaust system including a plurality of expansion chambers separate from said main expansion chamber and through which exhaust gases pass from said engine exhaust gas outlet to said slow speed exhaust gas discharge, said exhaust gases being delivered to said water chamber through a restricted opening for retarding the flow of exhaust gases for silencing.

14. In an exhaust system as set forth in claim 13 wherein the slow speed exhaust system includes means communicating the exhaust gases with each of the expansion chambers through a restricted opening.

15. In an exhaust system for an outboard motor or the like having a drive shaft housing and a lower unit adapted to be at least partially submerged in the water, an internal combustion engine having a cooling system and an exhaust gas outlet, a high speed exhaust gas discharge normally positioned below the water level, a slow speed exhaust gas discharge normally positioned above the water level, a high speed exhaust system for delivering exhaust gases from said engine exhaust gas outlet to said high speed exhaust gas discharge including a main expansion chamber formed at least in part in said drive shaft housing and an exhaust pipe extending from said exhaust gas outlet and opening into said main expansion chamber, and a slow speed exhaust system for delivering exhaust gases from said engine exhaust gas outlet to said slow speed exhaust gas discharge and including a water chamber formed in said drive shaft housing through which exhaust gases must pass from said exhaust gas outlet to said slow speed exhaust gas discharge, the improvement comprising said slow speed exhaust system including a plurality of expansion chambers separate from said main expansion chamber and through which exhaust gases pass from said engine exhaust gas outlet to said slow speed exhaust gas discharge, and an exhaust cooling jacket surrounding said exhaust pipe and receiving coolant from said engine cooling system.

* * * * *